United States Patent [19]

Narayanan et al.

[11] Patent Number: 4,682,988

[45] Date of Patent: Jul. 28, 1987

[54] PHENOLIC RESIN BONDED GRINDING WHEELS

[75] Inventors: Kesh S. Narayanan, Holden; Gordon E. Hickory, Upton, both of Mass.

[73] Assignee: Norton Company, Worcester, Mass.

[21] Appl. No.: 545,321

[22] Filed: Oct. 25, 1983

Related U.S. Application Data

[63] Continuation-in-part of Ser. No. 06/442,547, Nov. 18, 1982, abandoned, which is a continuation of Ser. No. 06/170,383, Jul. 21, 1980, abandoned.

[51] Int. Cl.[4] ..... C09K 3/14

[52] U.S. Cl. ..... 51/298; 528/107; 528/118

[58] Field of Search ..... 51/298; 528/107, 118

[56] References Cited

U.S. PATENT DOCUMENTS 3,406,020 10/1968 D'Alessandro ..... 51/298

4,239,503 12/1980 Harris et al. ..... 51/298

*Primary Examiner*—Prince E. Willis

*Assistant Examiner*—Willie Thompson

*Attorney, Agent, or Firm*—Arthur A. Loiselle

[57] ABSTRACT

A grinding wheel is described which is bonded with a phenol formaldehyde resin based bond containing hexamethylenetetramine as the curing agent. The wheels are made by first wetting the abrasive with furfural in varying quantities relative to the amount of hexamethylenetetramine in the phenol formaldehyde resin. Different amounts of the curing agent require different specific amounts of furfural to produce optimum properties in the finished grinding wheel.

7 Claims, 1 Drawing Figure

SCHEMATIC DIAGRAM OF GRINDING RATIO VS FURFURAL CONTENT AT VARIOUS HEXA LEVELS

SCHEMATIC DIAGRAM OF GRINDING RATIO VS FURFURAL CONTENT AT VARIOUS HEXA LEVELS
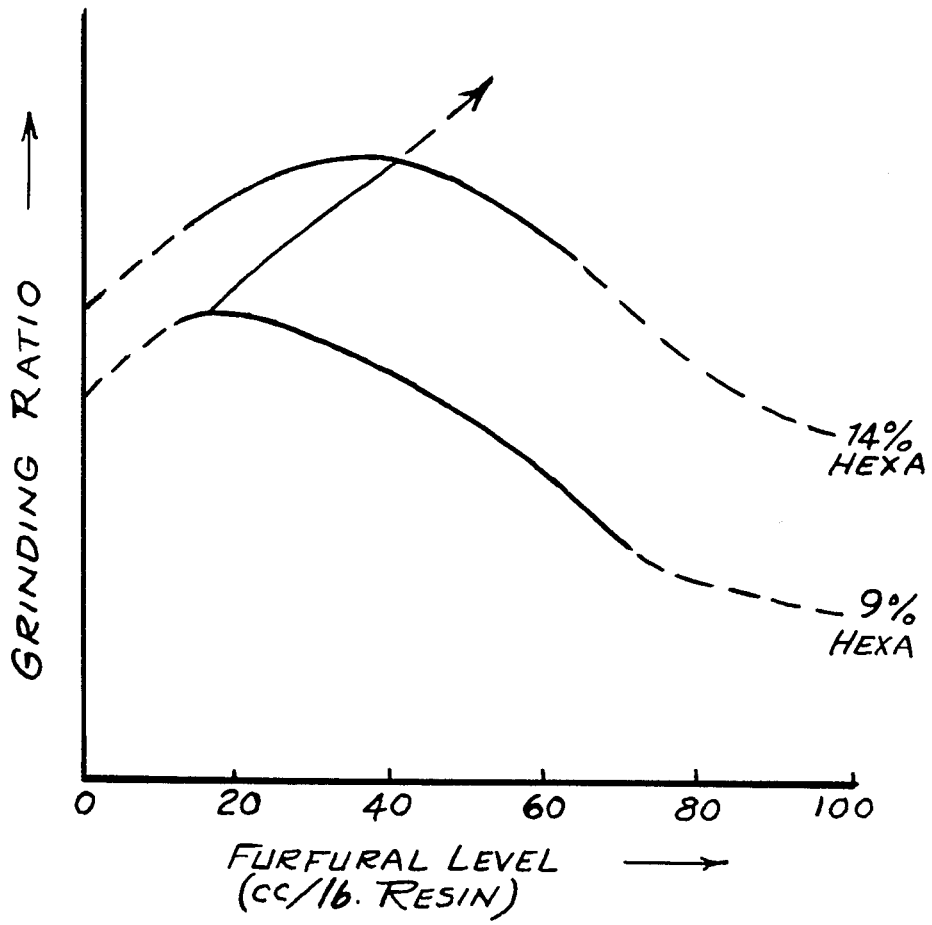

PHENOLIC RESIN BONDED GRINDING WHEELS

This is a continuation-in-part of application Ser. No. 06/442,547 filed Nov. 18, 1982 abandoned Oct. 25, 1983 which is a continuation of application Ser. No. 06/170,383 filed July 21, 1980, now abandoned.

TECHNICAL FIELD

The invention relates to organic polymer bonded grinding wheels. More specifically the invention is concerned with grinding wheels bonded with hexamethylenetetramine cured phenolic resin used for example as snagging wheels and cut-off wheels.

BACKGROUND ART

Prior Art Statement

The following patents are representative of the most relevant prior art known to the Applicants at the time of filing of the application:

| | | |
|---|---|---|
| | U.S. PAT. NO. | |
| 3,406,020 | October 15, 1968 | W. J. D'Alessandro |
| | FOREIGN PATENT | |
| 1,207,766 | October 7, 1970 | United Kingdom |

In the manufacture of resin bonded grinding wheels, a measured amount of abrasive grain is mixed with a powdered phenolic resin based bonding composition, then the resulting mix is pressed to form a wheel shape and the resin is cured. To promote a better pickup and bonding of the resin to the abrasive grains, it has been found useful to wet the grains with furfural prior to mixing the grain with the resin bond composition. The U.S. Pat. No. 3,406,020 to D'Alessandro, Oct. 15, 1968 and British Patent to Norton Company, No. 1,207,766, published Oct. 7, 1970, describe such a wheel making procedure.

D'Alessandro teaches the making of phenolic bonded abrasive wheels having various additives mixed with the grain and bond composition that are alleged to produce a bonded wheel having an enhanced flexural strength. Various kinds of abrasive grains such as alumina, corundum, silicon carbide and diamond grains are mentioned for inclusion in the wheel bonded with a novolak resin with hexamethylenetetramine hardening agent. The hardening agent is used within a range of about 2% to 50% based on the weight of the novolak, the preferred range being from about 3% to 20% and more particularly 7% to 15%. This patent describes the use of from 0 to about 100 parts of a wetting agent per hundred parts of novolak, the wetting agent being selected from a group consisting of liquid resole resin, cresol, furfural and furfural alcohol. The wetting agent is blended with the abrasive grain in proportions of about 40 parts liquid phenolic resin wetting agent to 80 parts powdered novolak binder and in another formulation of 10 to 20 parts furfural with 120 parts of solid novolak resin. The formulation is controlled so that the abrasive mix of grains, wetting agent and resin binder are free flowing at room temperature and the only criterion for determining how much wetting agent to use is that the mix should remain relatively free flowing up to the time it is charged into the mold.

The British patent is concerned with the making of an improved self-dressing manually controlled foundry snagging wheel having a resin bond, the wheel having from 22% to 26% pores by volume and the abrasive being spinel or mullite grains or mixtures of such abrasive grits. The making of wheels of such porosity is described and in the preparation of the abrasive grain and resin bond from which the wheel is molded, with reference to the use of furfural, there is only one comment and it is said that furfural is used in a conventional manner as a plasticiser in an amount of 55 cubic centimeters per pound of dry resin bond. No mention is made of the amount of hexamethylenetetramine employed.

DISCLOSURE OF THE INVENTION

The present invention provides an improvement over the prior art with the disclosure of a relationship between the amount of furfural wetting agent used on the grain in relation to the amount of curing agent used in the resin bond.

Whenever the term "mix" is used herein it is meant to have that meaning well known in the grinding wheel art viz. a more or less granular mixture of abrasive grain coated with a powdered uncured polymer or resin. Similarly, when the terms "bond" or "resin bond" are used, these terms are intended to include bond made up of resin alone and those which contain one or more of the many fillers, grinding aids, and reinforcing media know in the art. It has been discovered that the maximum grinding ratio for any given wheel specification can be more assuredly attained when a preferred quantity of furfural wetting agent is applied to the grain prior to the mixing of the grain with the powdered phenolic resin bond. The furfural is used to wet the grain and is added to the grain in a certain proportion with respect to the hexamethylenetetramine curing agent used, which itself is added in a particular quantity to the resin bond to control the durability characteristic of the cured wheel.

It is known that the durability of a phenolic bonded grinding wheel such as a snagging wheel or cut-off wheel can be improved by increasing the crosslink density of the phenolic resin bond which is accomplished by increasing the amount of hexamethylenetetramine hardening agent used with the novolak resin. It has now been found that there is a unique relationship between the amount of furfural wetting agent applied to the grain in relation to the quantity of hardening agent used in the novolak resin bond composition, the quantity of wetting agent being varied in the manner taught herein in order to control the grinding ratio characteristic in the cured wheel.

It is therefore an object of this invention to provide a grinding wheel with improved durability and grinding ratio characteristics.

Another object is to provide a mixing procedure for relating the amount of furfural used to wet the grain to the amount of hexamethylenetetramine hardening agent in the bond in order to produce a grinding wheel having an improved durability and grinding ratio.

Another object of this invention is to teach how snagging and cut-off wheels and the like may be produced to have a maximum grinding ratio for their respective specific compositions.

Other objects will appear in the specification below.

BRIEF DESCRIPTION OF THE DRAWINGS

The FIGURE is a chart showing the variation of the grinding ratio of the finished abrasive wheels made in accordance with this invention by varying additions of furfural wetting agent added to the grain in relation to the quantity of hexamethylenetetramine hardening agent in the resin.

THE PREFERRED EMBODIMENTS

While the following discussion of the preferred embodiments is directed specifically at novolak resin i.e. phenol-formaldehyde condensate, it should be understood that other phenolic based polymers are within the scope of the invention e.g. modified phenol-formaldehyde resins, phenol-furfural resins and the like. The term "phenolic resin" as used herein, is intended to include such hexamethylenetetramine curable resins.

Conventional resin bonded grinding wheels that are subjected to the most difficult grinding operations include wheels such as cut-off wheels, billet snagging wheels and foundry snagging wheels used respectively for cutting steel, preparing steel billets for rolling and the like and for foundry snagging operations. Most of such wheels are made up of abrasive grains bonded with novolak resin based bond having a hexamethylenetetramine hardening agent in the bond to produce a heat hardenable bond with good durability. The amount of hardening agent used is known to have a direct bearing on the durability of the cured wheel structure since the crosslinking density of the wheel is varied by the use of more or less of this agent. However, heretofore durability has not been related to the amount of furfural coincidentally with the level of hexamethylenetetramine in the novolak resin.

It has now been found that the grinding ratio of a wheel, that is the amount of metal that can be ground away from the work per unit volume of the wheel consumed in the grinding operation, can be maximized for any given phenolic resin bond by using an optimum amount of furfural for wetting the grain to be mixed with the phenolic resin bond in proportion to the hexamethylenetetramine hardening agent present in the resin bond composition. While wetting of the grain with furfural prior to mixing the grain with a bond including a powdered novolak resin and possibly fillers, has been used in the past, the proportion of wetting agent applied to the grain has not been shown to be related in any way to the amount of hardening agent used in the phenolic resin bond composition. More particularly, it has not been known heretofore that the grinding ratio of the cured wheel can be controlled by varying the furfural wetting agent used on the grain in an amount that is relative to the amount of hexamethylenetetramine hardening agent in the novolak resin bond.

Referring to the data set forth in the drawing, it can be seen that when furfural is used as a wetting agent for the abrasive grains in grinding wheels bonded with novolak resin containing hexamethylenetetramine as the hardening agent, the best grinding ratios in the cured wheels can be consistently realized by using an amount of hexamethylenetetramine hardening agent in the range of from 9% to 14% in the phenolic resin bond mix and using from 20 to 60 cubic centimeters of furfural per pound of phenolic resin to wet the grains prior to mixing with the powdered resin bond composition. In the FIGURE, it is seen that as the quantity of furfural is increased in proportion to the increase in the quantity of hexamethylenetetramine in the novolak bond composition, that the grinding ratio is optimized in the resulting wheels. For each percentage of hardening agent in the resin bond composition within the 9% to 14% range, there is an optimum amount of furfural that should be used for wetting the grains prior to mixing with that powdered resin bond in order to maximize the grinding ratio for the cured grinding wheel having that particular phenolic bond composition. In following this invention, a phenolic resin bond can be formulated for use with a given batch of abrasive grains to produce the desired durability in a wheel by using more or less of the hexamethylenetetramine hardening agent and a corresponding specific amount of furfural to produce optimum grinding properties in the finished grinding wheel.

For comparison, a pair of snagging wheels were made to demonstrate the advantage of relating the amount of wetting agent to the curing agent used. The steel conditioning snagging wheels were made with 16 grit alumina-zirconia abrasive grain and were bonded with a conventionally used phenolic resin bond to produce very dense wheels. The grain in each wheel was wetted with furfural prior to mixing with the powdered novolak resin formulation containing 14% hexamethylenetetramine hardening agent. In one wheel the furfural level was 17 cubic centimeters per pound of resin in the wheel and in the other wheel, the furfural level was 40 cubic centimeters per pound of resin. The wheels were hot pressed and cured in a conventional manner to produce wheels 16 inches in diameter, 2 inches thick with a 6-inch hole in the center. The wheels were both mounted on a 30 horsepower snagging machine and operated with a head force of 400 pounds at a speed of 9500 surface feet per minute. The wheels were used to grind a low alloy steel, AISI4140. The rate of wheel wear in cubic inches/hour and metal removal in pounds/hour was measured along with the power required to drive each wheel during the test. The comparative grinding results were recorded as follows:

(a) the wheel made from grain wetted with 17 cc per pound of resin mix prior to mixing, showed wheel wear at a rate of 25.51 cubic inches per hour, the metal was removed at a rate of 116.6 pounds/hour, at 20.40 kilowatts, giving a grinding ratio of 4.57.

(b) the wheel identical with the wheel made with 17 cc except that the grains were wetted with 40 cc of furfural showed wheel wear at a rate of 20.82 cubic inches/hour, the metal was removed at a rate of 111.13 pounds/hour, with 18.88 kilowatts giving the more efficient grindino ratio of 5.34.

These results show an improved grinding ratio for the 40 cc wheel as should be expected from observing the 14% hexamethylenetetramine curve in the FIGURE. Approximately the same amount of metal was removed in each test, but with less power being required with the 40 cc wheel.

With some grinding wheel formulations, high amounts of furfural cannot be added to the abrasive grain during the mix preparation or a mix results which is difficult or impossible to handle. To overcome this problem, some of the total amount of furfural is added directly to the abrasive grain and the remainder is added, alone or admixed with a second liquid, to the mix after the bond has been added to the abrasive. The following is an example of this type of wheel specification.

In a second test hot pressed cut-off wheels were made with a novolak resin bond having a 9% hexamethylenetetramine hardening agent therein. Two wheels were made with 24 grit alumina abrasive grits, each wheel having a 24-inch diameter, was 3/16 inch thick and had a $1\frac{3}{4}$ inch center hole. In one wheel 15 cubic centimeters of furfural was used to wet the grains prior to mixing with the powdered resin bond followed by an addition of furfural to the resin-abrasive mix to bring the total furfural to 55.9 cc per pound of resin.

In fabricating the other wheel in the same manner, 30 cc of furfural was added directly to the abrasive grain, with a second quantity of furfural added to the resin-abrasive mix to bring the total furfural to 70 cc per pound of resin.

Several tests were made with the resulting wheels. A dry cutting Tabor Hydraulic Chop machine was used to drive the wheels at 2200 RPM. Round bars of 304 stainless steel 2" in diameter were cut requiring six seconds for each cut. The data shows that the wheels made with grains wetted with 59.9 cc of furfural per pound of resin had an average grinding ratio of 3.21 and the wheels made with grains wetted with 70.9 cc of furfural had an average grinding ratio of 2.50 as would be expected from inspecting the 9% curve in FIGURE.

Another test was run with these cut-off wheels on a grinder to produce a plunge cut using 20 kilowatts of power to drive a Fox swing frame grinder. A plunge cut of 2 inches was made on ClO18CR steel. This machine was run at 1900 RPM. During this test, the wheel made with the 59.9 cc of furfural had a grinding ratio of 0.99 and the wheel made with 70.9 cc of furfural had a grinding ratio of 0.86.

These tests confirm that when the same power is applied to the different cut-off wheels made with different amounts of furfural in proportion to the hexamethylenetetramine curing agent present, a higher grinding ratio results when the preferred lower amount of furfural is used in a 9% hexamethylenetetramine bond, confirming the furfural relationship.

Still further tests were conducted using cold pressed cut-off wheels made up of abrasive grain, novolak resin bond containing various levels of hexamethylenetetramine, and various amounts of furfural; the wheels contained about 10% porosity. The wheels were 16"×$\frac{1}{8}$"×1" and where tested cutting $1\frac{1}{2}$" diameter stainless steel, at 12,000 sfpm, and 4 seconds per cut for 30 cuts on each wheel. The results were as follows:

| Furural ($cm^3$/lb) of dry resin) | Hexamethylene-tetramine (wt. % of resin) | Grinding Ratio (MR/Ww) |
|---|---|---|
| 10 | 9 | 3.52 |
| 20 | 9 | 4.44 |
| 40 | 9 | 4.96 |
| 20 | 14 | 5.06 |
| 40 | 14 | 5.36 |
| 60 | 14 | 5.86 |
| 20 | 19 | 4.84 |
| 40 | 19 | 5.56 |
| 60 | 19 | 5.71 |
| 80 | 19 | 5.56 |

As can be seen from the foregoing experimental test data, there is an approximate relationship that exists between the furfural and the hexamethylenetetramine, that produces an optimum grinding ratio. That approximate relationship can be expressed by the simple equation:

$$F=H+35$$

where F is the amount of furfural expressed as cubic centimeters of furfural per pound of resin, H is the weight percent of hexamethylenetetramine in the resin, and the 35 is an approximate constant.

In the laboratory several different tests can be made under controlled conditions to compare the relative strength of cured resin bonded grinding wheel compositions. For these tests, bars having the same abrasive grits and resin bond composition therein as are used in a standard wheel composition, are molded and cured in the same manner as the snagging wheels described above. The flexural strength of each of the cured bars is measured by using a flexural span of 2" with a 3 point bending flexural mode on an Instron test machine to determine the average breaking strength. This flexure test shows that the wheel strength is maintained even though furfural is varied to optimize grinding ratio while the durability is also increased, as is evident from the following data.

A number of 5"×$\frac{1}{2}$"×$\frac{1}{4}$" bars was made with 24 grit alumina-zirconia abrasive with a modified resin bond that included a carbosota wetting agent used with the powdered phenolic resin in an amount of about 20 cc per pound of resin. In these bars the abrasive was bonded with novolak containing 9% and 14% addition of hexamethylenetetramine curing agent, with 17 cc, 40 cc and 60 cc of furfural to wet the grain and the mix was:

| | Vol. % | Wt. % |
|---|---|---|
| $ZrO_2$—$Al_2O_3$ grit | 54 | 71.9 |
| Resin Bond | 46 | 28.1 |
| | 100 | 100.0 |

The resulting cured bars were tested to determine the average psi to break 4 bars at each furfural level. The average strength at the 17 cc level was 14,490 psi, at 40 cc level it was 15,400 and at the 60 cc level it was 14,150. This data shows that the wheel strength remains high with the addition of larger amounts of hexamethylenetetramine hardening agent. The addition of furfural to the grain during mixing in proportion to the quantity of hexamethylenetetramine present preserves the strength of the bond as the hexamethylenetetramine content increases.

The recognition that the ideal amount of furfural addition to the grain is related to the quantity of hexamethylenetetramine hardening agent in the bond is important because it serves to improve the durability and grinding ratio of modern grinding wheels which is desired because of the industry's introduction of new, higher powered steel conditioning grinders. When these heavier machines are operated at their full capacity for snagging steel billets, for example, the most durable wheels are desired. Wheels more durable than those heretofore known are produced according to the present invention, by combining the proper quantities of furfural and hexamethylenetetramine.

In general it has been observed that certain combinations of the amount of a furfural wetting agent used with abrasive grains bonded with a novolak phenolic resin having a hexamethylenetetramine hardening agent in the bond to produce a grinding wheel has an effect on the grinding ratio, durability, and strength of the cured wheel. When the hexamethylenetetramine levels are above 12% by weight in the resin and up to and including a 20% addition of this hardening agent, the furfural level should be varied proportionately from 20 cc of furfural per pound of resin to wet the grain, to as much as 60 cc of furfural per pound of resin. Wheels made in accordance with the teaching of this invention are otherwise produced with known techniques for mixing, use of additives such as fillers, grinding aids and the like, hot or cold pressing and curing the phenolic resin mix to produce the desired wheel.

While the above describes the preferred form of this invention, it is possible that modifications thereof may occur to those skilled in the art that will fall within the scope of the following claims. It should be understood that the present invention is independent of the type of abrasive used and therefore encompasses abrasives such as fused and sintered alumina, fused and sintered alumina-zirconia, silicon carbide, spinel, flint, mullite, cubic boron nitride, boron carbide, diamond and the like, and mixtures thereof.

What is claimed is:

1. A phenolic resin bonded grinding wheel with an improved grinding ratio in which hexamethylenetetramine is the curing agent and furfural is the wetting agent applied, at least in part, to the abrasive grain in the preparation of the wheel mix, said furfural being used in an amount of from 20 to 60 cubic centimeters per pound of resin, the furfural being incorporated in the wheel formulation in an increasing amount as the amount of hexamethylenetetramine curing agent in the resin increases from 12% to 20% by weight, the relationship of the amounts of furfuralto hexamethylenetetramine being approximately $F=H+35$ where F is the amount of furfural expressed in cubic centimeters per pound of resin and H is the amount of hexamethylenetetramine expressed in weight percent of the powdered resin.

2. An abrasive mix for producing snagging and cut-off wheels of improved grinding ratios wherein abrasive grains are bonded in a powdered phenolic resin bond having a hexamethylenetetramine hardening agent, comprising abrasive grain wetted with furfural, said wetted grain being mixed with said powdered resin bond and wherein additional furfural may be added to said mix to bring the total quantity of furfural to an amount proportioned to the quantity of hexamethylenetetramine hardening agent in the bond, the relationship of the amounts of furfural to hexamethylenetetramine being apporximately $F=H+35$ where F is the amount of furfural expressed in cubic centimeters per pound of resin and H is the amount of hexamethylenetetramine expressed in weight percent of the powdered resin.

3. An abrasive mix as in claim 2 wherein said furfural is present in an amount of from 20 to 60 cubic centimeters per pound of resin.

4. An abrasive mix as in claim 2 wherein said hexamethylenetetramine hardening agent is present in from 12% to 20% by weight of said resin and said furfural is added in an amount of from 20 to 60 cubic centimeters per pound of resin.

5. An abrasive mix as in claim 1 wherein said hexamethylenethtramine is present in said resin in an amount of 14% by weight of said resin and said furfural is added in an amount of 40 cc per pound of resin mix.

6. An abrasive mix in any of claims 1, 2, 3, 4 or 5 wherein said phenolic resin is a novolak resin.

7. A method of improving the grinding ratio and durability of a resin bonded abrasive grinding wheel wherein the abrasive grain is wetted with furfural before the grain is mixed with a powered novolak resin having a hexamethylenetetramine hardening agent therein, comprising wetting the grain with furfural, then mixing the furfural wetted grain with a powdered novolak resin bond with the hexamethylenetetramine hardener therein optionally adding a second quantity of furfural to the resin-abrasive mix and prior to wetting the grain, measuring out a total quantity of furfural in an amount related to the quantity of hexamethylenetetramine in the resin bond, said amount falling within a range of from 20 to 60 cc of furfural per pound of resin when the hardening agent is present in from 12 to 20% by weight of said resin mix, the relationship of the amounts of furfural to hexamethylenetetramine being approximately $F=H+35$, where F is the amount of furfural expressed in cubic centimeters per pound of resin and H is the amount of hexamethylenetetramine exporessed in weight percent of the powdered resin.

* * * * *